United States Patent [19]

LaFleur

[11] Patent Number: 4,479,651

[45] Date of Patent: Oct. 30, 1984

[54] JIG-SAW PUZZLE WORK BOARD

[76] Inventor: Robert H. LaFleur, 1729 Cresthill, Royal Oak, Mich. 48073

[21] Appl. No.: 419,966

[22] Filed: Sep. 20, 1982

Related U.S. Application Data

[62] Division of Ser. No. 236,803, Feb. 23, 1981, abandoned.

[51] Int. Cl.[3] ..... A63F 9/10; B65D 85/00

[52] U.S. Cl. ..... 273/157 R; 206/315.1; 273/DIG. 30

[58] Field of Search ..... 273/157 R, DIG. 30; 434/155; 128/DIG. 15; 206/315.1

[56] References Cited

U.S. PATENT DOCUMENTS

| | | | |
|---|---|---|---|
| 1,987,496 | 1/1935 | Springborn | 273/157 R |
| 2,560,583 | 7/1951 | Lupton | 273/148 A X |
| 3,504,915 | 4/1970 | Walker | 273/157 R |
| 3,729,752 | 5/1973 | Huggins | 128/DIG. 15 X |
| 3,792,668 | 2/1974 | Ward | 273/157 R X |
| 3,974,576 | 8/1976 | Quinn | 434/155 |
| 4,051,607 | 10/1977 | Sullivan | 273/157 R X |
| 4,154,339 | 5/1979 | Dutra | 273/157 R X |
| 4,302,013 | 11/1981 | Kavis | 273/157 R |

*Primary Examiner*—Anton O. Oechsle
*Attorney, Agent, or Firm*—Hauke and Patalidis

[57] ABSTRACT

A jig-saw puzzle work board forming a work surface recessed relative to a frame surrounding the work surface. The work surface is used for reconstructing a puzzle by placing the puzzle pieces together in a predetermined fashion, and a cover having a resilient facing or padding is placed over the work surface for preserving or storing away a partially reconstructed puzzle, the padding being made of resilient foam material having a surface engageable with the surface of the puzzle pieces and capturing the pieces and applying them against the work surface.

2 Claims, 5 Drawing Figures

JIG-SAW PUZZLE WORK BOARD

This is a division of application Ser. No. 236,803, filed Feb. 23, 1981 abandoned.

BACKGROUND OF THE INVENTION

The present invention relates to a jig-saw puzzle work board, and more particularly to a portable jig-saw puzzle work board and storing device.

Anyone who has ever indulged in piecing together jig-saw puzzles has, at a time or another, experienced the frustration of discovering in the morning that the partially done puzzle left overnight on a table had to be reconstructed all over again, because the table had been upset by a pet or a child and all the puzzle pieces are now lying on the floor.

Another dilemna often encountered by jig-saw enthusiasts is the continuous search for an adequate work surface, such as a spare table, on which to attempt to assemble the puzzle pieces. The spare table eventually becomes the most important table in the home, which forces one to move the partially completed puzzle to a less popular table. Another recurrent problem relates to storing a partially assembled puzzle, or even a completed puzzle, for a period of time while working on another puzzle.

SUMMARY OF THE INVENTION

These and other problems are solved by the present invention which provides a portable jig-saw puzzle work board on which the puzzle pieces may be disposed and assembled, the work board forming a framed recessed work surface provided with a lid which is removably or hingedly placed over the recessed work surface. The lid has an elastomeric lining resiliently and elastically deformable such as to contour itself around the puzzle pieces and hold them securely in position against the work surface and which permits to store a finished or partially assembled puzzle without upsetting or disturbing the assembly of pieces.

These and other objects and advantages of the present invention will become apparent to those skilled in the art when the following description of the best mode contemplated for practicing the invention is read in conjunction with the accompanying drawing wherein:

DETAILED DESCRIPTION OF THE PREFERRED EMBODIMENTS

Figure 1:
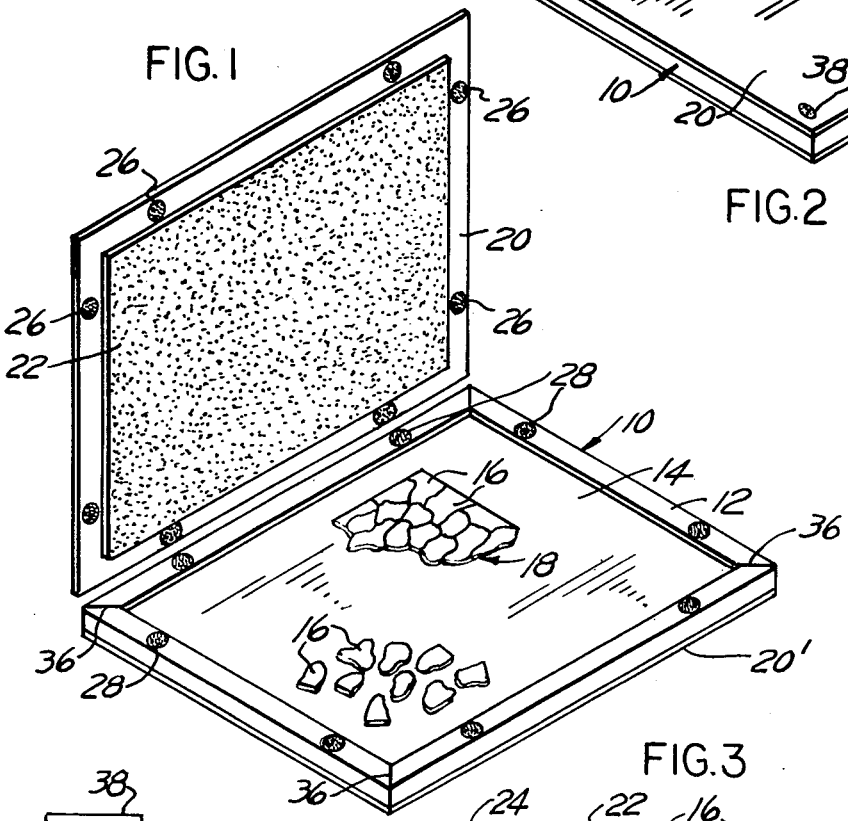
FIG. 1 is a perspective view of a jig-saw puzzle work board and storage according to the present invention.
Figure 2:
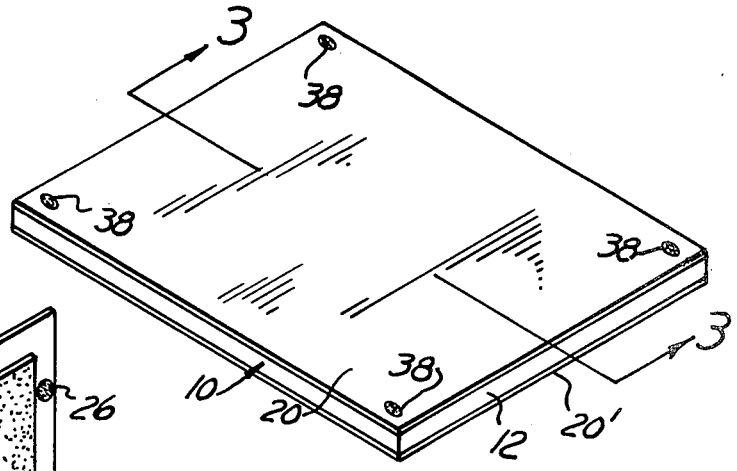
FIG. 2 is a perspective view of the jig-saw puzzle work board and storage of FIG. 1 with a cover in position over the work surface.
Figure 3:
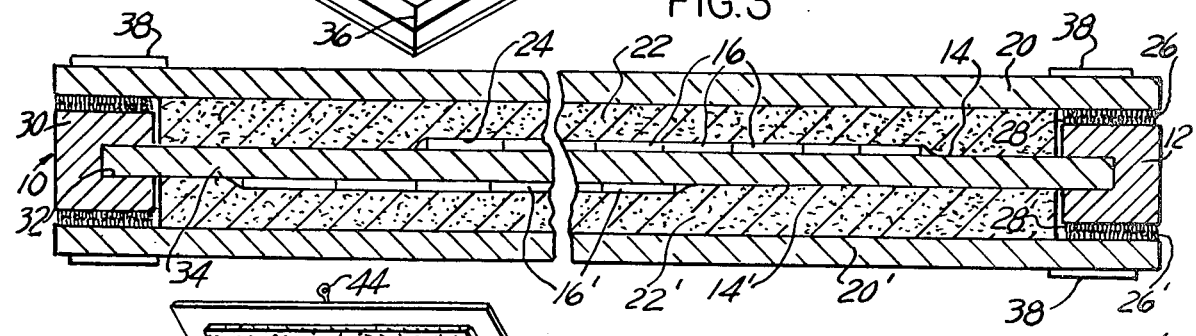
FIG. 3 is a sectional view along line 3—3 of FIG. 2.

Referring to FIG. 1 of the drawing, the invention is a jig-saw puzzle work board 10 in the form of a shallow box having a four-sided frame 12 defining the perimeter of a recessed plane work surface 14 used for reconstructing a jig-saw puzzle by interlocking the jig-saw puzzle individual pieces 16 together, as shown at 18 where there is illustrated a partly assembled puzzle. A cover or lid 20 provided with an elastomeric lining or padding 22 is adapted to be securely fastened over the work board 10, such that the elastomeric padding 22, for example made of foam rubber or resilient foam plastic, fits within the four-sided frame 12, as best shown at FIG. 3, and resiliently holds the diverse interlocked puzzle pieces 16 in assembly firmly against the work surface 14, by elastic deformation of the surface of the elastomeric padding 22, as shown at 24.

The lid 20 is securely held in position over the work board 10 by being provided with patches of Velcro material 26 attached, as by cementing for example, proximate the edge of the lid 20 beyond the area covered by the elastomeric padding 22, corresponding patches 28 of complementary Velcro material being attached to the surface of the frame 12 at appropriate positions so as to be each aligned with a patch 26, when the lid 20 is placed in position over the work board. The thickness of the elastomeric padding 22 is such that when the lid 20 is in position over the board 10, the free face of the padding 22 at least touches the work surface 14 to enable the padding to apply sufficient pressure on the puzzle pieces 16 to safely and securely hold them in interlocked assembly against the work surface 14.

As an example of structure and of the materials for making the jig-saw puzzle work board 10 of the invention, the edge frame 12 is conveniently made of square or rectangular, in cross-section, wood molding 30 provided with a groove 32 in which is inserted and glued the edge of a rectangular plank or panel 34 made of plywood, masonite or other convenient material. Appropriate lengths of grooved molding 30 are cut with their ends at a 45° angle such as to form glued miter joints 36, FIG. 1. Preferably, the groove 32 is disposed substantially at the center of a side of the wood molding 30 such that, as best shown at FIG. 3, two work surfaces 14 and 14' are formed each on a side of the panel 34. A second cover or lid 20', also provided with an elastomeric lining or padding 22', is provided for holding in interlocked assembly the diverse pieces 16' of another puzzle, even if partially completed, while utilizing the work surface 14, the second lid 20' being held in position in the same manner as the lid 20 by means of corresponding Velcro patches 26' and 28'.

The lids 20 and 20' may be provided, if so desired, with appropriate felt pads 38 attached to their exposed surface to avoid marring the surface on which the work board 10 is placed either for storage or while working on a puzzle. Without a lid attached over one of the working surfaces 14 or 14', the Velcro patches 28 or 28' act as protection preventing marring the surface on which the work board 10 is placed.

Figure 4:
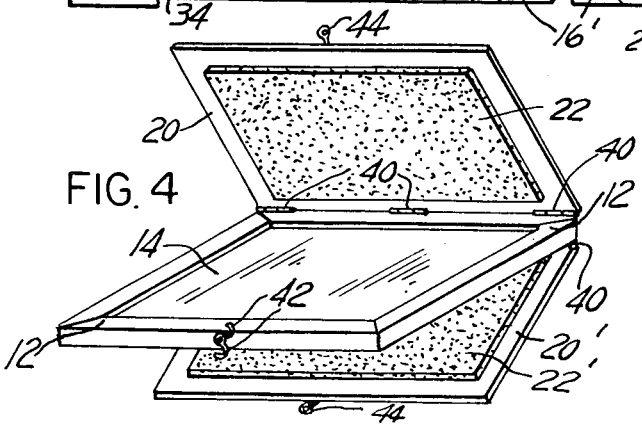
FIG. 4 is a perspective view of a modification thereof provided with hinged lids.
Figure 5:
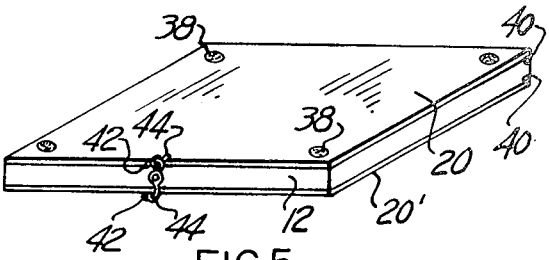
FIG. 5 is the jig-saw puzzle work board and storage of FIG. 4 shown closed.

Instead of providing completely removable lids 20 and 20', the invention also contemplates that the lids 20 and 20' as shown at FIGS. 4 and 5, each be conveniently hinged attached to the frame 12 by way of appropriate hinges 40, such as piano hinges or the like. The lids 20 and 20' are held securedly in position over the work surfaces by way of, for example, pivotable S-shaped hooks 42 or the like each engaging a pin 44 affixed to the edge of the lids 20 and 20'.

It will be appreciated that jig-saw puzzles are available in several sizes, the most common sizes being 16×20 in. (41×51 cm.), 18×24 in. (46×51 cm.) and 24×30 in. (61×76.5 cm.). Consequently a work surface 14 having an area slightly larger than 24×30 in. permits to work on most jig-saw puzzles available on the market. It will be further appreciated that a work board 10 having a single work surface, and a corresponding cover for protecting and storing unfinished puzzles, can be used, without the cover, as a display frame for the finished puzzle by cementing the pieces to the work surface as the pieces are assembled to reconstruct the original picture. If it is desired to remove the reconstructed puzzle from the work surface, a piece of paper may be placed over the work surface and the puzzle removed from the recessed work area when finished.

Having thus described the present invention by way of structural embodiments thereof, modification whereof will be apparent to those skilled in the art, what is claimed as new is as follows:

I claim:

1. A portable jig-saw puzzle work board comprising a rectangular four-sided frame, said frame having a top surface, a bottom surface, and a four-sided inner wall extending from said bottom surface to said top surface, a rectangular panel mounted between said sides of said inner wall proximate the middle of said inner wall, two work surfaces defined by the respective sides of said panel, one of said work surfaces being recessed relative to said top surface of said frame and the other of said work surfaces being recessed relative to said bottom surface of said frame, a first lid which overlaps said top surface of said frame when said first lid is in a closed position and a second lid which overlaps said bottom surface of said frame when said second lid is in a closed position, a padding attached to a side of each of said lids, each of said paddings being attached to a lid along one surface of the padding, each of said paddings being made of resilient elastomeric material and having length and width dimensions enabling the padding to fit within said inner wall of said frame with the other surface of the padding freely extending to a recessed work surface such that said freely extending other surface of the padding resiliently engages puzzle pieces placed on a recessed work surface and holds said puzzle pieces in a fixed position by applying pressure thereto, a plurality of patches of Velcro material also attached to said side of each of said lids, said patches of Velcro material being disposed proximate the edges of said lids beyond the area of said lids covered by said paddings, and corresponding patches of complementary Velcro material attached to said surfaces of said frame at appropriate positions such that each corresponding patch of complementary Velcro material is aligned with a patch of Velcro material when said lids are in said closed positions.

2. The jig-saw work board of claim 1 further comprising protective felt patches attached to a surface of said lid.

* * * * *